US005441029A

United States Patent [19]

Hlousek

[11] Patent Number: 5,441,029

[45] Date of Patent: Aug. 15, 1995

[54] FUEL INJECTION SYSTEM FOR INTERNAL COMBUSTION ENGINES

[75] Inventor: Jaroslaw Hlousek, Golling, Austria

[73] Assignee: Robert Bosch GmbH, Stuttgart, Germany

[21] Appl. No.: 293,191

[22] Filed: Aug. 19, 1994

[30] Foreign Application Priority Data

Sep. 22, 1993 [DE] Germany ..... 43 32 119.4

[51] Int. Cl.[6] ..... F02M 63/02; F02M 51/06

[52] U.S. Cl. ..... 123/467; 123/446; 239/96

[58] Field of Search ..... 123/446, 447, 467, 500, 123/501; 239/96

[56] References Cited

U.S. PATENT DOCUMENTS

| | | | |
|---|---|---|---|
| Re. 33,270 | 7/1990 | Beck et al. | 123/446 |
| 3,777,977 | 12/1973 | Regneault et al. | 239/96 |
| 3,802,626 | 4/1974 | Regneault et al. | 239/96 |
| 3,943,901 | 3/1976 | Takahashi et al. | 123/467 |
| 4,333,436 | 6/1982 | Kopse et al. | 123/467 |
| 4,417,557 | 11/1983 | Walter | 123/467 |
| 4,605,166 | 8/1986 | Kelly | 239/96 |
| 4,911,127 | 3/1990 | Perr | 123/446 |
| 4,979,674 | 12/1990 | Taira et al. | 123/467 |
| 4,982,713 | 1/1991 | Buisson | 123/467 |
| 5,176,120 | 1/1993 | Takahashi | 123/447 |
| 5,357,933 | 10/1994 | Kasahara et al. | 123/446 |

FOREIGN PATENT DOCUMENTS

| | | |
|---|---|---|
| 0397106 | 11/1990 | European Pat. Off. . |
| 1440002 | 6/1976 | United Kingdom . |

OTHER PUBLICATIONS

Electronic Controlled Fuel Injection System for Clean Diesel Engine by Toshihiko Omori, pp. 28–33, 1992.

*Primary Examiner*—Thomas N. Moulis
*Attorney, Agent, or Firm*—Edwin E. Greigg; Ronald E. Greigg

[57] ABSTRACT

A fuel injection system for internal combustion engines, having a high-pressure fuel pump and a feed line that feeds fuel from a low-pressure chamber into a pressure-regulatable high-pressure collection chamber. The high pressure collection chamber, which communicates with individual injection units via high-pressure lines. These injection units, which correspond in number to the injection locations in the combustion chamber of the engine to be supplied, are each composed of one injection valve and one three-way valve that controls the injection. A first pressure chamber at the injection valve communicates continuously with the valve seat thereof and with the high-pressure line, and a second pressure chamber, defined at least indirectly by the end face remote from the seat of the injection valve member, communicates with the three-way valve, which connects the second pressure chamber alternatingly with the high-pressure line or a relief line into the low-pressure chamber, in order to control the injection process. According to the invention, the three-way valve is embodied as a double seat valve, which forms a throttling function in the relief direction of the second pressure chamber.

16 Claims, 1 Drawing Sheet

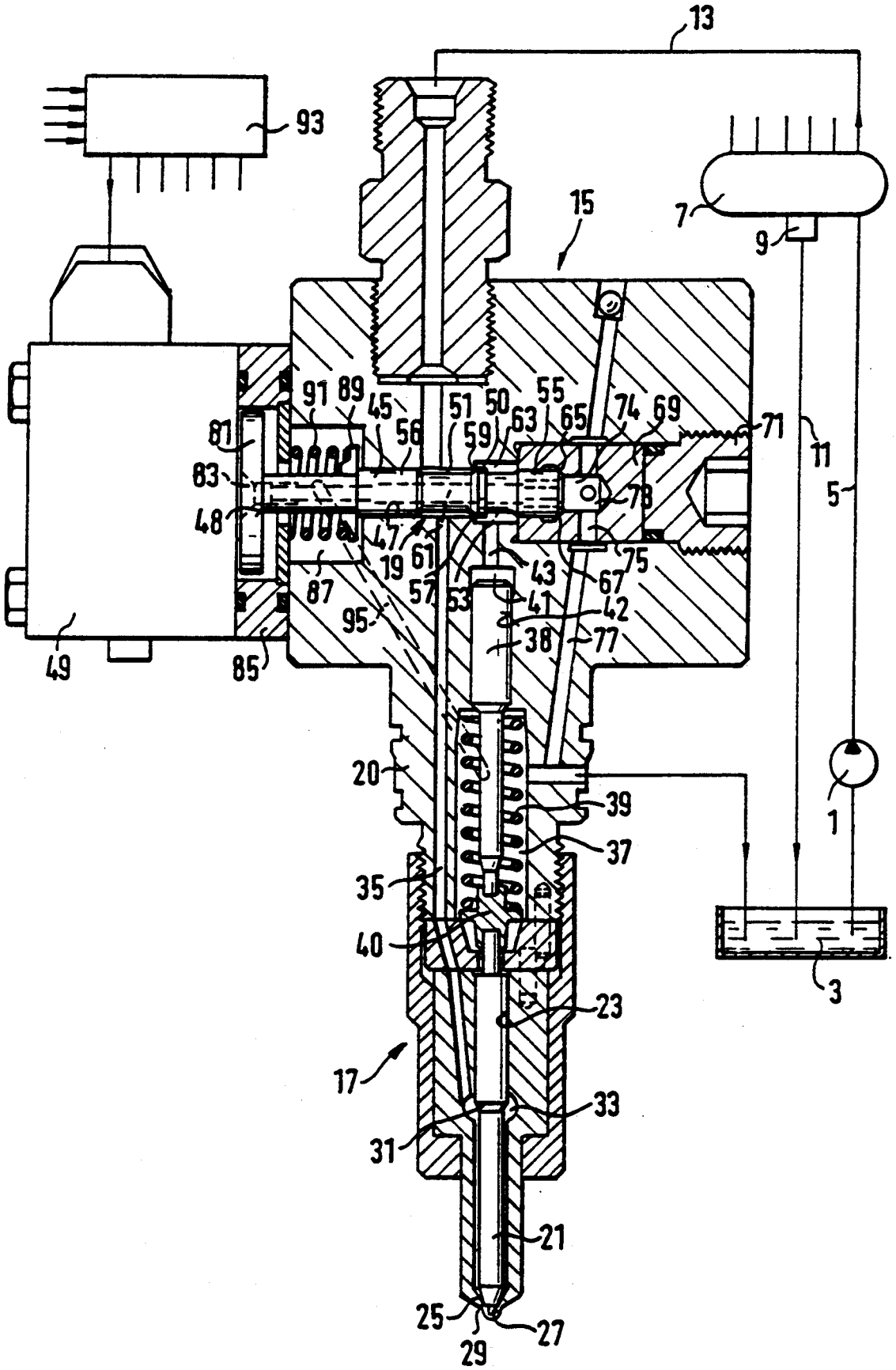
13
93
15
7
9
91
89
45
51
50
55
74
69
71
81
56
59
63
65
11
83
78
5
48
47
61
19
43
67
75
87
57
53
41
42
95
38
77
49
85
20
39
1
37
35
40
3
23
17
33
31
21
25
27
29

FUEL INJECTION SYSTEM FOR INTERNAL COMBUSTION ENGINES

BACKGROUND OF THE INVENTION

The invention is based on a fuel injection system for internal combustion engines as defined hereinafter. In one such known fuel injection system, in which for optimal fuel combustion in the engine combustion chamber, in addition to free control of the injection onset and end, the injection pressure can also be regulated freely, a high-pressure fuel pump feeds fuel from a fuel supply tank at high pressure via a feed line to a high-pressure collection chamber, which communicates via high-pressure lines with the various injection units, which correspond in number to the injection locations in the combustion chamber of the engine to be supplied. These injection units each comprise one injection valve, protruding into the engine combustion chamber, and one three-way valve controlling it; the valve member of the injection valve, which is in the form of a seat valve, has on its shaft a pressure face formed by a cross-sectional reduction in the direction of the valve seat, and with this face it protrudes into a first pressure chamber, which communicates continuously with the high-pressure line to the high-pressure collection chamber and with the injection port at the valve seat, and whose pressure acts upon the valve member in the opening direction. With its end remote from the valve seat, the valve member defines a second pressure chamber, which can be made to communicate via the three-way valve with either the high-pressure line or a relief line to the fuel tank; the effective cross section of the valve member acted upon by the pressure is less in the region of the first pressure chamber than in the region of the second pressure chamber.

Furthermore, a check valve opening in the direction of the second pressure chamber and a throttle in the line parallel to it are disposed between the second pressure chamber of the injection valve and the three-way valve, which is triggered by an electric control unit.

The injection process in the known fuel injection system is controlled as a function of engine operating parameters, by means of the three-way valve, which in the intervals between injection connects the second pressure chamber at the injection valve to the high-pressure line, so that the fuel pressure acting upon the larger end face keeps the valve member closed, counter to the opening force of the pressure face in the region of the first pressure chamber. If injection is to occur, then the three-way valve switches over and connects the second pressure chamber with the relief line, thus pressure-relieving it, and the fuel pressure in the first pressure chamber, acting upon the valve member in the opening direction, now suffices to lift the valve member from its seat. To avert overly rapid opening of the injection valve, with the attendant high injection rate, at the injection onset, the fuel flowing out of the second pressure chamber is throttled at the throttle restriction, so that the opening motion is slowed down and at first only a small quantity of fuel is injected into the combustion chamber and can then be prepared for optimal combustion. The end of injection is controlled by reconnecting the second compression chamber of the injection valve with the high-pressure line, following which the high pressure rapidly builds up in the second pressure chamber and thus moves the valve member back into its closing position.

However, the known fuel injection system has the disadvantage that the shaping of the injection course, particularly at the onset of injection, is done via a throttle restriction provided in addition to the three-way valve and via an additional check valve; these elements require additional space and involve additional production costs.

OBJECT AND SUMMARY OF THE INVENTION

The fuel injection system according to the invention has the advantage over the prior art that by integration of the injection course-shaping functions with the three-way valve, additional complicated and expensive components can be dispensed with, which not only lowers the production cost but also reduces the space required.

This is advantageously attained by embodying the three-way valve as a double seat valve, whose piston-like control valve member, which is axially adjustable between two stops embodied as valve seats, connects the second, face-end pressure chamber on the injection valve with either the high-pressure line or the relief line, depending on the switch position. The throttling function is achieved during the connection of the second pressure chamber with the relief line via a reduction in the flow cross section for the outflowing fuel within the three-way valve.

The throttling action of this throttle restriction can advantageously be varied by means of the dimensioning of an axial blind bore, receiving the control valve member, in a filler piece that closes off the bore guiding the control valve member; the injection course shaping can thus be well adapted to the particular engine by means of the easily exchanged filler piece.

The throttle cross section between the control valve member and the wall of the filler piece can be provided either between the circumferential face of the pistonlike control valve member and the wall of the bore guiding it, or by means of a limitation of the opening stroke of the control valve member; in that case, the throttle cross section may be formed at the face-end valve seat between the sealing face of the control valve member and the valve seat.

A further advantage is attained by the adjustable stroke of the control valve member of the three-way valve, by way of which the switching times can be varied, and which can also be adjusted by the manner in which the filler piece is designed.

The separate disposition of the electric control magnet that actuates the control valve member furthermore advantageously make it possible to use various commercially available control magnets; by disposing intermediate plates of variable thickness between the control magnet and the injection unit formed by the injection valve and the three-way valve, the valve stroke can be adjustable for any injection unit regardless of the control magnet.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the fuel injection system according to the invention.

DESCRIPTION OF THE PREFERRED EMBODIMENT

In the fuel injection system shown in the drawing, a high-pressure fuel pump 1, which for instance may be embodied as a piston pump, feeds fuel from a low-pressure chamber 3, embodied as a fuel tank, via a feed line 5 at high pressure to a high-pressure collection chamber 7. The pressure in the high-pressure collection chamber 7 is regulatable either via a pressure control valve 9, which is inserted into a return line 11, leading away from the high-pressure collection chamber 7 into the low-pressure chamber 3 and works as a function of engine operating parameters, or by means of the volumetric efficiency of the high-pressure fuel pump.

From the high-pressure collection chamber 7, high-pressure lines 13 also lead to the individual injection units 15, which correspond to the number of injection locations for injection into the combustion chamber of the engine to be supplied, and which are each formed of one injection valve 17, that protrudes into the engine combustion chamber, and one three-way control valve 19, which are disposed in a common housing 20.

The injection valve 17 is embodied as a seat valve, with a pistonlike injection valve member 21, which is axially guided in a guide bore 23 and one face end of which has a conical sealing face 25, with which it cooperates with a valve seat 29 that adjoins an injection port 27. On its shaft, the injection valve member 21 has a pressure shoulder 31, formed by a cross-sectional reduction that points in the direction of the valve seat 29; with this shoulder, it protrudes into a first pressure chamber 33, formed by an increase in diameter of the guide bore 23, the pressure chamber continuing in the form of an annular gap around the shaft of the injection valve member 21 and extending as far as the valve seat 29 and communicating continuously, via a connecting line 35 in the housing 20 of the injection unit 15, with the high-pressure line 13, through which the fuel pressure in the connecting line 35 is propagated into the first pressure chamber 33 and acts upon the injection valve member 21 in the opening direction, counter to the force of a valve spring 39 disposed in a spring chamber 37. This spring engages one end of the valve member 21, protruding on the side of the guide bore 23 remote from the valve seat 29, by way of a spring plate 40 upon which a piston 38 also acts, which piston has a diameter slightly larger than that of the guide bore 23 and with its face end remote from the valve seat 29 defines a second pressure chamber 41 in a blind bore 42 guiding that guides the piston 38. The second pressure chamber 41 communicates with the three-way control valve 19 via a connecting conduit 43, and the fuel pressure that can be built up in the pressure chamber 41 acts upon the injection valve member 21 in the closing direction.

The three-way control valve 19 communicates with the second pressure chamber 41 and is embodied according to the invention as a double seat valve, with a piston-like control valve member 45, which is guided in a housing bore 47 and on one face end 48 is acted upon by an electric control magnet 49 secured to the housing 20, and which on its jacket face has an annular rib 50 that divides a first annular-groove-like recess 51 from a second annular-groove-like recess 53; the diameter of the annular rib 50 is enlarged compared with the diameter of the valve member segments 55, 56 that define the two recesses 51, 53 on the other side.

The annular end face of the annular rib 50 oriented toward the face end 48 acted upon by the control magnet changes conically from the outer diameter to the inner diameter, which corresponds to the diameter of the first recess 51, and thus forms a first conical valve sealing face 57, which cooperates with a first valve seat 59 created by means of a conical enlargement of diameter of the housing bore 47; a first flow chamber 61 between the wall of the housing bore 47 and the control valve member 45 is formed between the first valve seat 59 and the end of the first recess 51 remote from the annular rib 50. The high-pressure line 13 to the common high-pressure collection chamber 7 discharges into this first flow chamber 61, and from the high-pressure collection chamber the connecting line 35 leads to the first pressure chamber 33 of the injection valve 17; the connecting line 35 continues to communicate constantly with the high-pressure line 13.

On the side remote from the control magnet 49, the first valve seat 59 defines a second flow chamber 63, into which the connecting conduit 43 to the second pressure chamber 41 of the injection valve 17 discharges, and which chamber 63 extends outward beyond the region of the second recess 53 to a second valve seat 65 structurally connected to the housing; this second valve seat 65 is formed by a conical reduction in diameter of the housing bore 47, and it cooperates with a second valve sealing face 67 on the face end of the control valve member 45 remote from the control magnet 49.

The second valve seat 65 is disposed in a filler piece 69, receiving a part of the housing bore 47 and clamped in the housing 20 via a closure screw 71. The part of the housing bore 47 located in the filler piece 67 changes, in the manner of a stepped bore, into an axial blind bore 73 of smaller diameter in the extension of the housing bore 47. The diameter of the valve member segment 55 that protrudes into the filler piece 69 is slightly smaller than the diameter of the part of the housing bore 47 that guides the valve member segment 55; the free cross section is dimensioned as smaller than the opening cross section at the second valve seat 65 and thus forms a throttling segment.

However, it is also possible to guide the control valve member 45 tightly in the housing bore 47 in the filler piece 69 by its valve member segment 55 adjoining the second valve sealing face 67, and to enable the flow of fuel via a longitudinal groove from a second flow chamber 63 into an inner annular groove in the housing bore that adjoins the second valve seat 65 toward the flow chamber.

From the axial blind bore 73, which forms a third flow chamber 74, a transverse bore 75 communicates with the low-pressure chamber 3 via a relief line 77, and when the control valve member 45 is lifted from the second valve seat 65, the second flow chamber 63 can be relieved via this transverse bore 75.

On its end toward the control magnet 49, an armature plate 81 is mounted on the control valve member 45 and is clamped by means of a screw 83; the plate 81 cooperates with the control magnet 49 (not shown in detail), which is mounted on the housing 20 of the injection unit 15 in an axial extension of the housing bore 47, with an interposed intermediate plate 85. The housing bore 47 becomes larger in the region of the outlet toward the intermediate plate 85 and thus forms a spring chamber 87, in which a restoring spring 91 is disposed, fastened to the control valve member 45 between an annular disk of the intermediate plate 85 and a spring plate 89; in the currentless state of the control magnet 49, the restoring spring keeps the control valve member 45 of the three-way control valve 19 in contact with the second valve seat 65, by means of its second valve sealing face 67.

Triggering of the control magnet 49 is done by means of an electronic control unit 93, which processes operating parameters of the engine to be supplied and by way of which the control of the pressure control valve 9 can also be done.

For pressure equalization at the control valve member 45, a pressure equalization conduit 95 is provided between the spring chamber 87 of the control valve member 45 and the spring chamber 37 of the injection valve member 21; the spring chamber 37 of the injection valve 17 also communicates with the relief line 77. An axial through bore may also be disposed in the control valve member 45; it would connect the spring chamber 87 with the part of the blind bore 73 that is defined by the face end of the control valve member 45 remote from the control magnet. The diameters of the valve member segments 55 and of the sealing faces at the valve seats 59, 65 are also designed to be equal, to achieve an equilibrium of forces at the control valve member.

The fuel injection system according to the invention functions as follows:

When the engine is started, the high-pressure pump 1 feeds fuel from the low-pressure chamber 3 to the high-pressure collection chamber 7, where it builds up a high fuel pressure that is adjustable via the pressure control valve 9.

This high fuel pressure is transmitted via the high-pressure lines 13 to the various injection units 15; there it continues, first via the connecting line 35 into the first pressure chamber 33 of the injection valve 17 and, if the electric control magnet 49 is without current, in which case the control valve member 45 of the three-way valve 19 rests with its second valve sealing face 67 on the second valve seat 65, then it continues on via the first flow chamber 61 and the second flow chamber 63 at the three-way valve 49 and via the connecting conduit 43 to enter the second pressure chamber 41 of the injection valve 17. By means of the effective area of the piston 38, which is defined by the second pressure chamber 41 and is larger than the effective area of the pressure shoulder 31 in the first pressure chamber 33, and with the support of the valve spring 39 as well, the injection valve member 21 is held against the valve seat 29 so that the injection valve 17 is closed.

If injection is to occur, then the electric control magnet 49 is supplied with current by the control unit 93 and consequently displaces the control valve member 45 of the three-way control valve 19 so as to contact its second stop, counter to the force of the restoring spring 91; in other words, the first valve sealing face 57 comes to rest against the first valve seat 59 and closes the communication between the first flow chamber 61, which communicates with the high-pressure line 13, and the second flow chamber 63, which communicates with the second pressure chamber 41. At the same time, the communication between the second flow chamber 63 and the third flow chamber 74, which communicates with the relief line 77 and is formed by the blind bore 73, is opened up, so that the pressure in the second pressure chamber 41 is relieved. As a result of this outflow, throttled by the small flow cross section in the region 55, from the second pressure chamber 41 and as a result of the attendant pressure drop, the force acting in the opening direction in the first pressure chamber 33 upon the injection valve member 21 is now sufficient to lift this member from its valve seat 29 counter to the force of the valve spring 39, so that the injection valve 17 opens, and the fuel reaches injection at the injection port 27.

If the injection is to be ended, then the electric control magnet 49 is switched to be currentless again via the control unit 93; the control valve member 45 is again moved by the restoring spring 91 so that its first valve sealing face 57 is moved away from the first valve seat 59, so that the second flow chamber 63 again communicates with the high-pressure line 13, and thus in the second pressure chamber 41 of the injection valve 17 a high pressure that presses the injection valve member 21 with its sealing face 25 against the valve seat 29 again builds up, and this high pressure keeps the injection valve closed counter to the pressure in the first pressure chamber 33.

Because the injection valve 17 is thus kept closed when the control magnet 49 is currentless, it can be assured that the engine to be supplied can be turned off quickly and safely in an emergency by cutting the current to the system.

In the fuel injection system according to the invention, the instant of injection and the injection pressure can be adjusted freely as a function of operating parameters, via the control unit 93.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines, having a high-pressure fuel pump (1), a feed line (5) which feeds fuel from a low-pressure chamber (3) into a high-pressure collection chamber (7), said high pressure collection chamber communicates via high-pressure lines (13) with individual injection units (15) that correspond to the number of injection locations connectioned with the combustion chambers of the engine to be supplied, each of the injection units having an injection valve (17), an injection valve member (21) which protrudes into the engine combustion chamber, said injection valve cooperates with a valve seat (29) to control the injection, said injection valve includes a pressure face (31) located in a first pressure chamber (33), said pressure face (31) is acted upon in an opening direction by the pressure in the first pressure chamber (33), a second pressure chamber (41) on the back side of said valve member, remote from the valve seat (29) that can be acted upon at least indirectly by the pressure, wherein the first pressure chamber (33) communicates continuously with the high-pressure collection chamber (7) via a connecting line (35) connected with the high-pressure line (13), and a three-way control valve (19), controlled by an electronic control unit (93) by means of a control magnet (49), said three-way control valve (19) has a control valve member (45) which has first and second sealing faces (57, 67) said first sealing face (57) cooperates with a first valve seat (59) and said second sealing face cooperates with a second valve seat (65), said valve member (45), in a first position, comes to rest on the first valve seat (59) with said first sealing face (57) and in so doing closes a communication between the high-pressure line (13) and the second pressure chamber (41) and opens a communication between the second pressure chamber (41) and a relief line (77), and in a second position said valve member opens a connection betweeen said high pressure line and said second pressure chamber (41), the control valve member (45) in said first position permits a communication between the second pressure chamber (41) and the relief line (77) and defines a throttle cross section and in its second position produces an unthrottled communication, which permits a flow in both flow directions, between the second pressure chamber (41) and the high-pressure line (13).

2. A fuel injection system as defined by claim 1, in which the control valve member (45) is embodied in pistonlike fashion and is guided inside a housing bore (47) and has an annular recess (53), which with the housing bore (47) defines a flow chamber (63) that communicates continuously with the second pressure chamber (41), and having a valve member segment which adjoins the annular recess (53) on one side and includes said first sealing face (57), and having a pistonlike valve member segment adjoining the annular recess (53) on the other side, which segment has the second sealing face (67) on a face end remote from the recess (53) and which segment defines the throttle cross section toward the housing bore (47).

3. A fuel injection system as defined by claim 2, in which the control valve member (45) has an annular rib (50), which divides the annular recess (53) from a further annular recess (51) in the jacket face of the control valve member (45), and whose outer diameter is enlarged compared with the diameter of the valve member segments (55, 56) defining the two recesses (51, 53) on the other side.

4. A fuel injection system as defined by claim 3, in which the first valve seat (59) is formed by a diameter enlargement of the housing bore (47) that discharges into the flow chamber (63).

5. A fuel injection system as defined by claim 1, in which the first and second valve sealing faces (57, 67) and the first and second valve seats (59, 65) of the three-way control valve (19) are embodied conically.

6. A fuel injection system as defined by claim in which the control valve member (45) is guided in the housing bore (47) by its valve member segments (55, 56) that define the recesses (51, 53), and a first flow chamber (61) is disposed in a region of the first recess (51), near the control magnet, on the control valve member (45), and the second flow chamber (63) is disposed in the region of the second recess (53), remote from the control magnet, of the control valve member (45).

7. A fuel injection system as defined by claim 2, in which the control valve member (45) is guided in the housing bore (47) by its valve member segments (55, 56) that define the recesses (51, 53), and a first flow chamber (61) is disposed in a region of the first recess (51), near the control magnet, on the control valve member (45), and the second flow chamber (63) is disposed in the region of the second recess (53), remote from the control magnet, of the control valve member (45).

8. A fuel injection system as defined by claim 3, in which the control valve member (45) is guided in the housing bore (47) by its valve member segments (55, 56) that define the recesses (51, 53), and a first flow chamber (61) is disposed in a region of the first recess (51), near the control magnet, on the control valve member (45), and the second flow chamber (63) is disposed in the region of the second recess (53), remote from the control magnet, of the control valve member (45).

9. A fuel injection system as defined by claim 4, in which the control valve member (45) is guided in the housing bore (47) by its valve member segments (55, 56) that define the recesses (51, 53), and a first flow chamber (61) is disposed in a region of the first recess (51), near the control magnet, on the control valve member (45), and the second flow chamber (63) is disposed in the region of the second recess (53), remote from the control magnet, of the control valve member (45).

10. A fuel injection system as defined by claim 5, in which the control valve member (45) is guided in the housing bore (47) by its valve member segments (55, 56) that define the recesses (51, 53), and a first flow chamber (61) is disposed in a region of the first recess (51), near the control magnet, on the control valve member (45), and the second flow chamber (63) is disposed in the region of the second recess (53), remote from the control magnet, of the control valve member (45).

11. A fuel injection system as defined by claim 1, in which the housing bore (47) is closed on the side remote from the control magnet (49), by a filler piece (67) with an axial blind bore (73) that extends the housing bore (47), the segment (55) of the control valve member (45) protrudes into the axial blind bore (73) and said blind bore via a diameter reduction forms the second valve seat (65).

12. A fuel injection system as defined by claim 11, in which the axial blind bore in the filler piece (69) forms a third flow chamber (74) and, via a transverse bore (75) intersecting said blind bore communicates with the relief line (77).

13. A fuel injection system as defined by claim 1, in which an armature plate (81) cooperating with the control magnet (49) is mounted on an end of the control valve member (45) toward the control magnet.

14. A fuel injection system as defined by claim 13, in which an intermediate plate (85) is disposed between the housing of the control magnet (49) and the housing (20) of the injection unit (15).

15. A fuel injection system as defined by claim 14, in which a spring chamber (87) is provided on the end toward the control magnet of the control valve member (45), in which spring chamber a restoring spring (91) is fastened, between an annular disk of the intermediate plate (85) and a spring plate (89) acting upon the control valve member (45), which restoring spring (91) acts upon the control valve member (45) in the direction remote from the control magnet (49).

16. A fuel injection system as defined claim 15, in which the spring chamber (87) of the three-way control valve (19) and a chamber in the control magnet housing that receives the armature plate (81) communicate via a pressure equalization conduit (95) with a spring chamber (37) of the injection valve (17) that receives a valve spring (39), and this spring chamber (37) in turn communicates with the relief line (77) to the low-pressure chamber (3).

* * * * *